US005176471A

United States Patent [19]

Frafjord et al.

[11] Patent Number: 5,176,471

[45] Date of Patent: Jan. 5, 1993

[54] ARRANGEMENT AND METHOD FOR PROTECTING COMPONENTS IN SUBSEA SYSTEMS

[75] Inventors: Peter Frafjord, Hafrsfjord, Norway; Bruno Grandgeorge, Vallet, France

[73] Assignees: Den norske stats oljeselskap a.s., Stavanger, Norway; Mobil Oil Corporation, Fairfax, Va.

[21] Appl. No.: 684,942

[22] PCT Filed: Oct. 9, 1989

[86] PCT No.: PCT/NO89/00105

§ 371 Date: May 13, 1991

§ 102(e) Date: May 13, 1991

[87] PCT Pub. No.: WO90/04084

PCT Pub. Date: Apr. 19, 1990

[30] Foreign Application Priority Data

Oct. 14, 1988 [NO] Norway ..... 884587

[51] Int. Cl.[5] ..... F21B 33/037

[52] U.S. Cl. ..... 405/211; 166/356

[58] Field of Search ..... 166/356, 360, 364, 366; 405/211, 204, 224, 226, 227

[56] References Cited

U.S. PATENT DOCUMENTS

| | | | |
|---|---|---|---|
| 3,247,672 | 4/1966 | Johnson | 405/210 |
| 4,273,472 | 6/1981 | Piazza et al. | 405/211 |
| 4,625,805 | 12/1986 | Ladecky | 166/341 |

FOREIGN PATENT DOCUMENTS

| | | | |
|---|---|---|---|
| 860891 | 3/1986 | Norway . | |
| 2015062 | 8/1979 | United Kingdom | 405/211 |
| 2142361 | 1/1985 | United Kingdom . | |
| 2226352 | 6/1990 | United Kingdom | 405/211 |

*Primary Examiner*—David J. Bagnell
*Attorney, Agent, or Firm*—Foley & Lardner

[57] ABSTRACT

Arrangement for protecting components such as valves and control units incorporated in subsea structures particularly for hydrocarbon production, including a template structure adapted to rest on the sea bed and provided with supporting members for a number of functional modules, each containing at least one of the components, each being adapted to be retrieved to the surface. Each of the modules is provided with at least one fixed roof element and at least one completely removable roof element, these fixed and removable roof elements together covering substantially the entire top area of the module, and the roof elements of all modules in the subsea structure together cover a major portion of the top area of the subsea structure to protect against objects falling from above or moving along the sea bed, such as trawls or the like. The roof elements are of a structure adapted to be permanently deformed or crushed when a falling object results in an impact force thereon exceeding a predetermined threshold value. The loads from the roof elements of the modules are transferred to the supporting members of the template structure through the modules. The roof elements of all modules are lying substantially in a common plane without any significant part of the subsea structure protruding above the flush roof elements.

10 Claims, 4 Drawing Sheets

ARRANGEMENT AND METHOD FOR PROTECTING COMPONENTS IN SUBSEA SYSTEMS

BACKGROUND OF THE INVENTION

1. Field of the Invention

This invention relates to an arrangement for protecting components such as valves and control units incorporated in a subsea structure particularly for hydrocarbon production. More specifically, the invention is directed to a protective roof arrangement intended to protect components in the subsea structure against objects dropped from above or moving along the seabed, such as trawls or the like.

The present subsea structure consists of a template which is secured to the seabed and modules retrievable to the surface for maintenance. There are different types of modules, all designed according to a similar pattern so as to interface with installation, maintenance ,and inspection tools. They are "integrated modules", in that, although some parts of the module are retrievable separately from the rest of the module, the module can be installed in one run with all of its components;-.mounted thereon. As described hereinafter, these integrated modules include protective roof elements arranged in a specific manner according to the present invention.

2. Discussion of the Related Art

When a subsea station is in production mode, all the units constituting it are or may be installed onto the template main structure. It is important during production periods and also when other operations are performed on or near the subsea station, that, objects, dropped into the water or moved along the seabed, for example in connection with fishing operations, do not interfere with the normal functioning of the subsea station or even cause damage to the station.

For achieving protection similar to what is contemplated here, more conventional designs propose a separate roof, either integrated and hinged into the template structure, or run after installation of the necessary equipment on the template. This results in additional and more delicate operations than what is made possible by the solution according to this invention, as will appear from the following description. One particular drawback with a conventional design, is an increased risk of objects dropped on a module when it is retrieved, since there is no roof protecting it. An example of such known design for protective roofing for subsea installations is found in U.S. Pat. No. 4,273,472, issued Jun. 16, 1981, to A. Piazza. Published GB Patent Application No. 2,195,686 shows an example of a typical subsea station or template structure without any roofing.

SUMMARY OF THE INVENTION

The arrangement according to the present invention provides for full protection against trawls and dropped objects. In short, this is achieved by having roof elements integrated into the modules. This makes it possible to retrieve every module with its protecting roof arrangement intact, which means that there is no added risk of dropped object damage during such operations, and the preparatory work to retrieve a module is simpler than in the case of conventional designs. Moreover, the present roofing arrangement covering the template and the retrievable modules thereon is such that the whole system is over-trawlable and the equipment is well protected against dropped objects.

The novel and specific arrangement according to this invention, involving the above and other advantages, primarily consists in that each of the modules is provided with at least one fixed roof element and at least one completely removable roof element. These fixed and removable roof elements together cover substantially the entire top area of the module, and the roof elements of all modules in the subsea structure together cover a major portion of the top area of the subsea structure to protect against objects falling from above or moving along the sea bed. The roof elements are of a structure adapted to be such as trawls or the like, permanently deformed or crushed when a falling object results in an impact force thereon exceeding a predetermined threshold value, the loads from the roof elements of said modules being transferred to the supporting members of the template structure through the modules. The roof elements of all modules are lying substantially in a common plane without any significant part of the subsea structure protruding above the flush roof elements.

In addition to the roof elements supported by the modules, there may also be provided one or more roof elements supported directly by the template structure. These latter roof elements, however, cover a comparatively small portion of the total top area of the template.

Under certain circumstances, one or more of the production modules may not be installed. In such cases a dummy module is installed to maintain the flush roofing arrangement.

BRIEF DESCRIPTION OF THE DRAWING

Other novel and specific features of the arrangement according to the invention, as well as further advantages obtained, will be explained in the following description with reference to the drawings, in which.

DETAILED DESCRIPTION OF THE PREFERRED EMBODIMENTS

Figure 1:
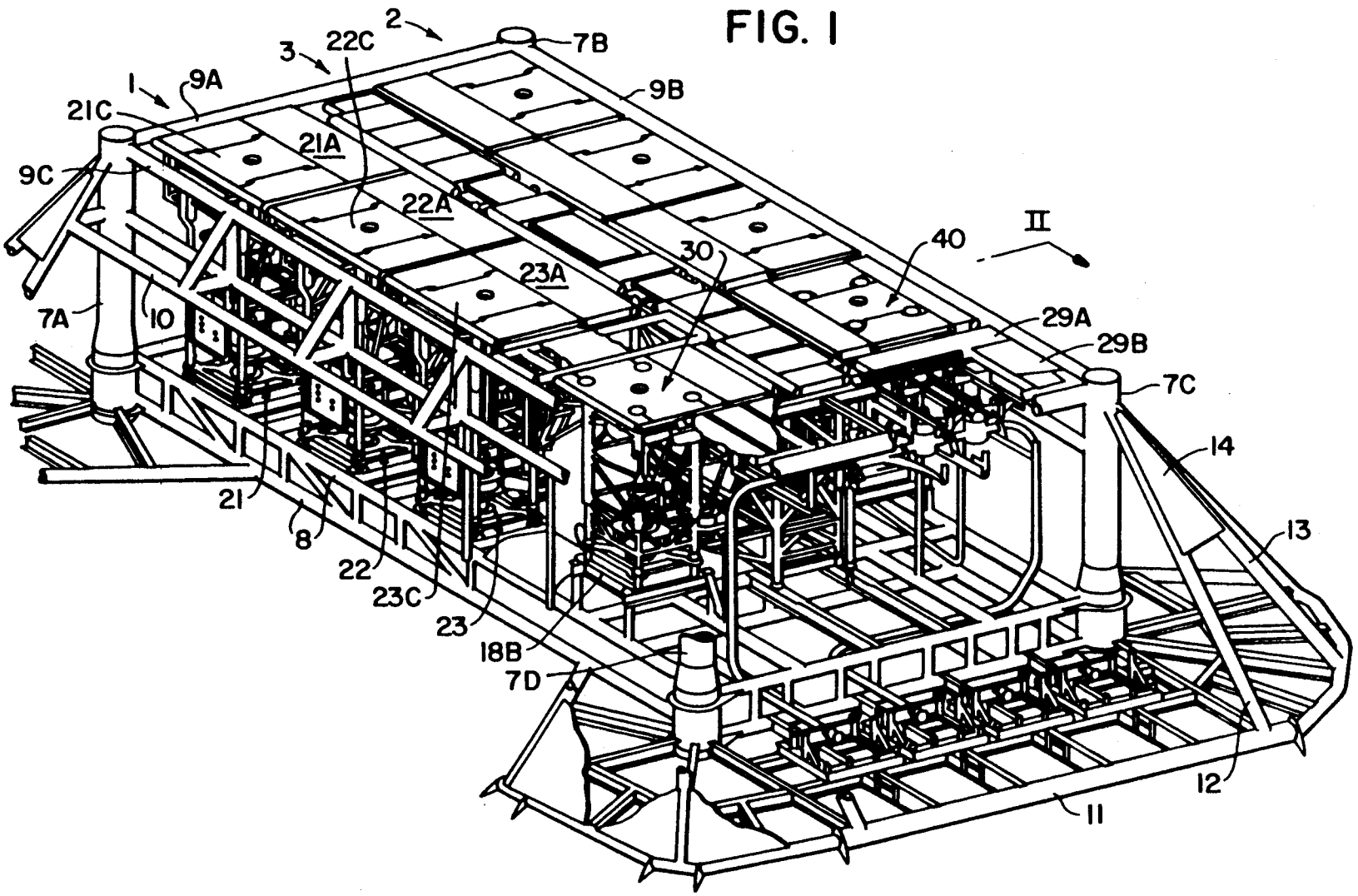
FIG. 1 shows in isometric view a complete subsea station or structure with some parts cut away or removed for better illustration.

The template main structure on which the subsea station is built up, may be of a general rectangular shape and is mainly made up of tubular columns and beams. Thus, at the corners there are shown columns 7A, 7B, 7C and 7D interconnected by a framework of tubular beams of which bottom or supporting members 8 are indicated in FIG. 1. Between the upper ends of columns 7A–D there are provided upper tubular beams as shown at 9A, 9B and 9C.

Columns 7A-D are intended to rest with their lower ends on the seabed together with associated structure, as exemplified by a lower transverse beam 11 at the righthand end of the subsea structure in FIG. 1. In actual practice the template is either levelled and secured to the seabed using piles driven through the columns or pile sleeves, or it may be levelled and rest on mud-mats dependent on the seabed condition. Inclined corner extensions are provided so as to obtain an overtrawlable arrangement, which is an arrangement deflecting trawls being towed along the seabed so as to be lifted and guided over the subsea structure without interferring with any part thereof. This trawl protection arrangement or extensions at each corner of the template comprise inclined tubular beams, such as beam 13, and the plates 14 connected to such beams in order to obtain a sufficiently rigid structure. The corner extensions are associated with a tubular beam or rail 10 running along the main structure on three faces of the template in FIG. 1. This rail 10 prevents trawls from entering or snagging the subsea structure and serves to deflect trawls towards the extensions at each corner of the template. On the fourth side, between beams 12, sloping roof modules 29 protecting the external lines' connections are installed to establish overtrawlability.

The functional modules or equipment contained in the subsea structure of FIG. 1 are arranged in three rows as indicated at 1, 2 and 3 at the upper left hand end of FIG. 1. In row 1 there are for example installed modules generally indicated at 21, 22, 23 and 30, whereas in row 2 one of the modules is indicated at 40. Row 3 essentially is a connection frame serving to establish the numerous interconnections between the modules in rows 1 and 2.

Figure 2:
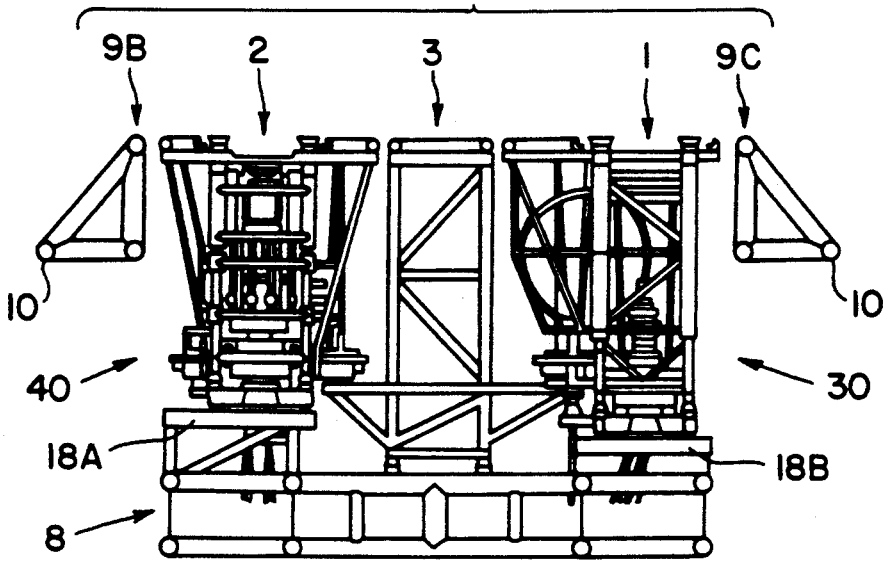
FIG. 2 shows a simplified cross-section as generally indicated by arrow II in FIG. 1.

FIG. 2 also shows some of the main structural features mentioned above with respect to FIG. 1. More particularly module 30 in FIG. 2 (as in FIG. 1) is supported by structural members 8 and 18B, the latter being provided at a height level adjusted according to the total height of module 30. In a similar way, module 40 is supported by members 18A which again is carried by the common lower supporting members or framework 8 near the bottom of the template.

Figure 3:
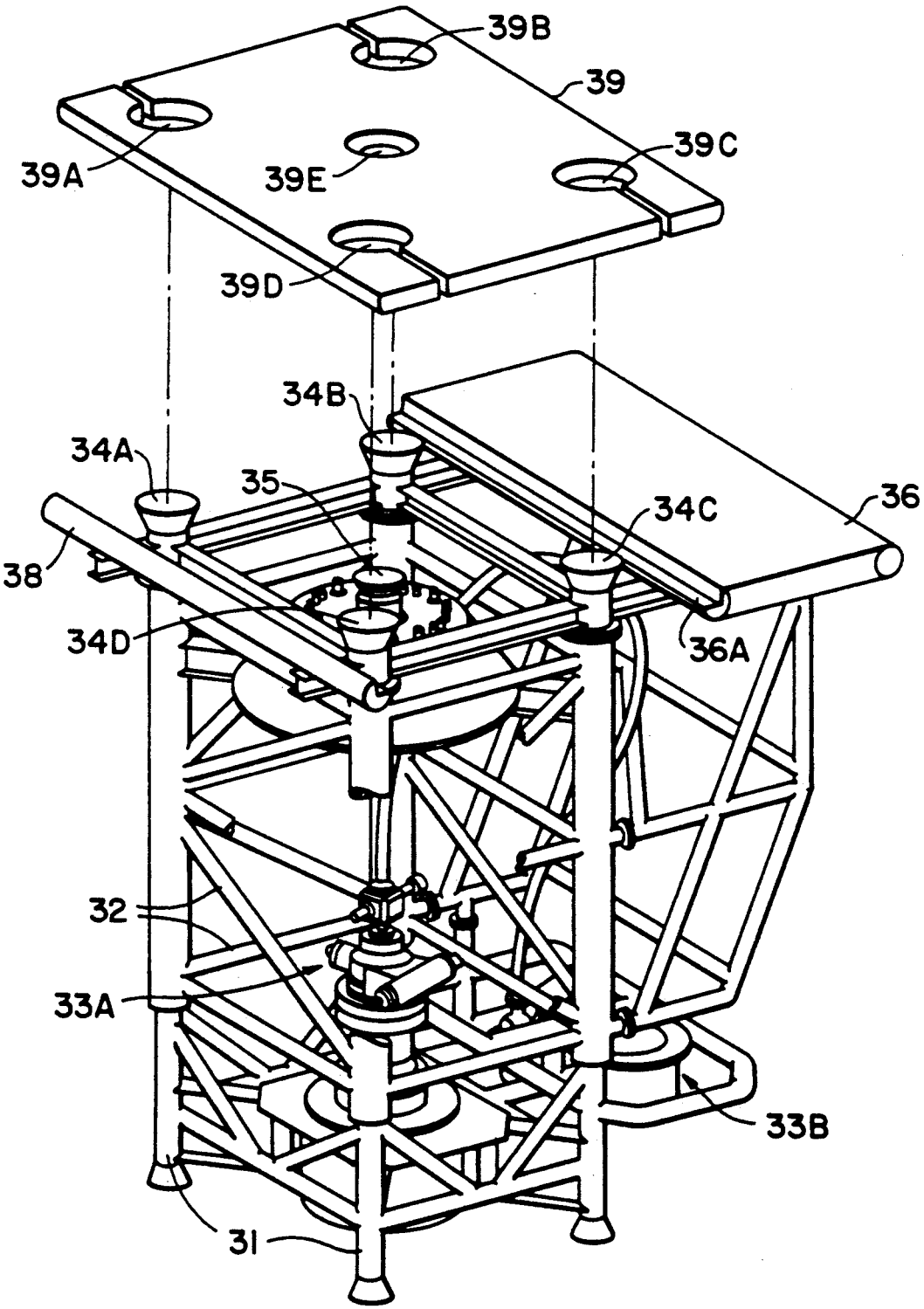
FIG. 3 shows in isometric view and with parts broken away an example of one type of module to be installed in a subsea station as illustrated in FIG. 1.
Figure 4:
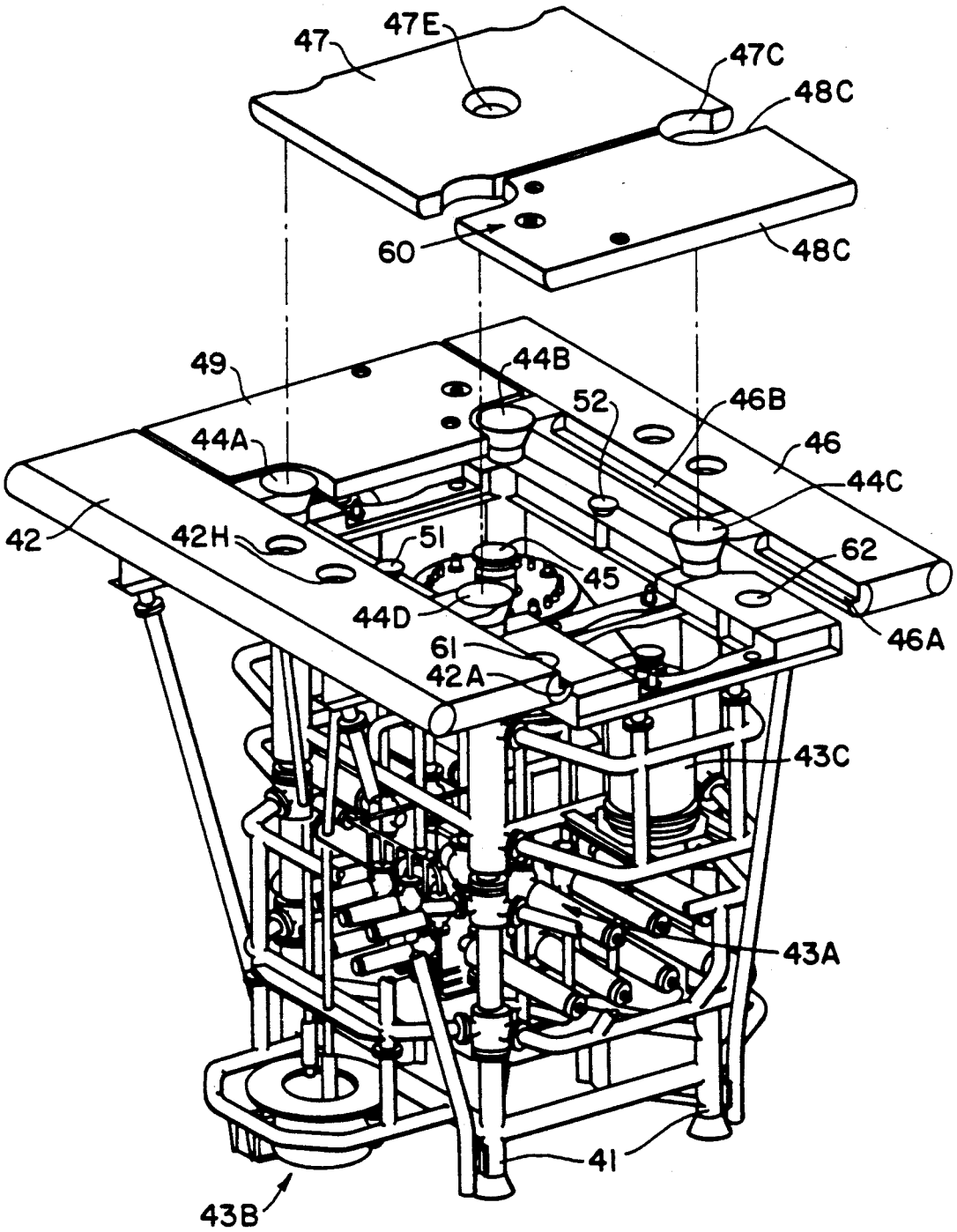
FIG. 4 shows in isometric view and with parts broken away an example of another type of module to be installed in a subsea station as illustrated in FIG. 1.

The modules incorporated in a complete subsea structure may be of several different types, and two examples of such modules are shown in more detail in FIGS. 3 and 4 respectively. FIG. 3 shows a so-called selector module and FIG. 4 shows a manifold module.

Referring to FIG. 3, the selector module comprises a protective and guiding framework with four columns or guide funnels 31 for installation by a typical guideline operation. Tubular beams, as indicated for example at 32, make up a complete framework, including a lower frame supporting the functional components or equipment in the module. The selector mechanism 33A is located centrally at the vertical axis of the module, above the main connector making up all process conduits and serving as the module anchor to the template, whereas an auxiliary component, such as a control connector 33B is mounted at one side of the main module structure. This control connector 33B is intended for carrying hydraulic and electrical power as well as signals from/to a field control centre.

Necessary means for anchoring the module to the subsea template structure, piping connections, shock absorbers, valves and other components which may be incorporated in the module shown in FIG. 3, need not be described in detail here. At the top part of the module there is shown a handling hub 35 for interfacing with a module running tool, which serves to install the complete module by manipulation from the sea surface, and conversely, to retrieve the complete module from the subsea structure for maintenance or the like.

In addition to the possibility of retrieving the complete module as just mentioned, some of the modules in the subsea structure contain one or more separately retrievable components, such as the control pods. These will be described more in detail in connection with FIG. 4.

At the top of the module there is provided a horizontal roof structure for protection against dropped objects and besides providing for overtrawlability. The roof structure in FIG. 3 comprises a fixed roof element 36 along one side of the module, protecting inter alia the component 33B mentioned above. This fixed roof element 36 is not designed for easy detachment from the complete module and therefore is retrievable together with the whole module.

The central part or top area of the selector module in FIG. 3 has a central, removable roof element 39, which in FIG. 3 is shown in an elevated position from the module itself. This roof element 39 is designed to be separately removable by means of a tool, which may be the guideline establishment tool. The module is installed or retrieved by the module running tool which covers the space normally covered by said roof element. Two longitudinal side edges of roof element 39 are shaped for co-operation with supports 36A at one side of the fixed roof element 36, and a separate supporting beam 38, respectively. Of course, there may also be other supporting points or areas at several places distributed over the (underside) area of the central, removable roof element 39.

For the purpose of guideline operations as mentioned above, roof element 39 has four holes 39A-D corresponding to funnels 34A-D respectively on top of the module framework. From each of the holes 39A-D there is a slot opening to an adjacent side edge of the roof element, these slots also being provided in view of the guideline operations. Finally, there is a central opening 39E allowing for a possible modification of the guideline establishment tool to grab and lock or unlock the roof arrangement. If necessary, taking into account, among other things, the size of opening 39E, there may be provided a protective cap covering this opening.

Turning now to the other example of a module incorporated in the the subsea structure or template on FIGS. 1 and 2, that is, the manifold module shown in FIG. 4, this has a main structure corresponding to the selector module described with reference to FIG. 3. Thus in FIG. 4 there are four columns or funnels 41 and associated tubular beams making up a framework for supporting a number of functional units or components, comprising main components or equipment indicated at 43A and auxiliary components such as control connector 43B and a control unit or pod 43C. The latter unit is an example of a component being separately retrievable from the module concerned. A central handling hub 45 is provided for running the module. This hub corresponding to the handling hub 35 in modules shown in FIG. 3. Also corresponding to what is shown in FIG. 3 are four funnels 44A-D for guideline operations. At this point it should be noted that this arrangement at the top of the module as well as the roof elements are all designed such that common tools can be used for different modules, for example, a common module running tool, in particular a remotely operated vehicle (ROV) or a remotely operated tool (ROT) designed to handle the separately retrievable individual units or components, such as control pods, valves or chokes.

As indicated above, the roof structure is of primary interest in connection with the modules described here. The manifold module shown in FIG. 4 is provided with two fixed roof elements 42 and 46, a central removable roof element 47 and two smaller, removable roof elements 48 and 49. The fixed roof elements 42 and 46 are mounted along opposite sides of the module and in the first place protect equipment and components along the adjacent sides of the module, the control connector 43B, for example, being covered by the fixed roof element 42. Note that two holes 42H in this roof element make it possible to access rods linked to the top of control connector 43B for a mechanical override thereof.

The central removable roof element 47 corresponds more or less to the removable roof element 39 in FIG. 3, that is, it serves to protect the main central area of the top of the module the corners of which are defined by funnels 44A–D. As in the case of the selector module in FIG. 3, these four funnels are adapted to be exposed at the top surface of the complete roof structure, which in the embodiement of FIG. 4 is made possible by corresponding recesses in two opposite side edges of roof element 47, one such recess being indicated at 47C, for accommodating funnel 44C. At the centre of roof element 47 there is an opening 47E serving a similar purpose as opening 39E in FIG. 3. The two sides of roof element 47 not being recessed, are adapted to rest on supports incorporated in the respective fixed roof elements 42 and 46, such support being shown at 46B in the latter fixed roof element. Roof element 47 may be kept in place when mounted on the supports just mentioned, exclusively by the effect of gravity.

Figure 5:
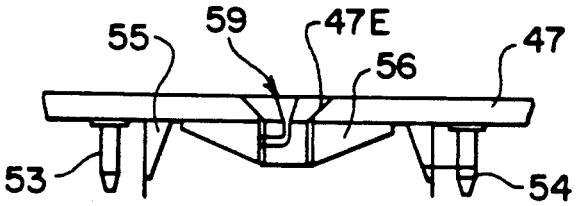
FIG. 5 shows in elevation a central and removable roof element for modules, such as the module in FIG. 4.

Reference is now made to FIG. 5 showing element 47 somewhat simplified in elevation. At the underside of this element there are provided guide pins 53 and 54 adapted to enter respective funnels 51 and 52 shown in FIG. 4, in order to properly position roof element 47 when mounted. Also shown in FIG. 5 is the funnel shape of opening 47E as well as an associated reinforcement plate structure 56 at the underside of the element, and a running tool receptacle 59. At the underside of the element there are also (partly) shown supporting members 55 for a specific protection collar to protect an underlying interface plate at the centre of which the handling hub 45 is located.

The two smaller, removable roof elements 48 and 49 are supported at their short ends on corresponding support areas or edges integrated into the longitudinal sides of the fixed roof elements 42 and 46. Thus for roof element 48 there are provided supports at 42A and 46A on fixed elements 42 and 46 respectively. For accommodating the four funnels 44A–D elements 48 and 49 are also recessed, as is the central roof element 47. At 48C one such recess in roof element 48 is indicated.

Above the retrievable component 43C there is provided an interface frame or arrangement making it possible for a remotely operated tool (ROT) to land and be connected to the top interface on component 43C for performing operations with respect thereto, in particular to unlock the same from the supporting module and carry the same to the surface. Before such an operation can be effected, the removable roof element 48 must be retrieved, and this can also be done by means of an ROT or an ROV.

Figure 7:
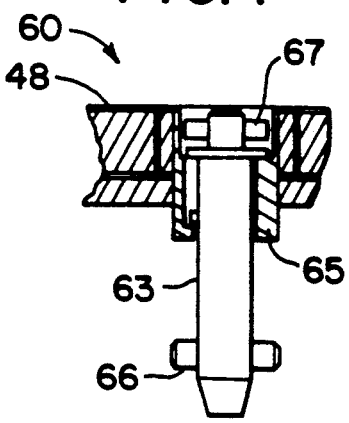
FIG. 7 shows an enlarged detail of the roof element in FIG. 6.
Figure 6:
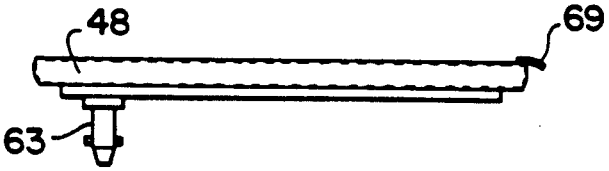
FIG. 6 shows in elevation another removable roof element for the module in FIG. 4.

Since normally these small roof elements 48 and 49 are mounted on the module when the module is run (to or from the subsea structure), they need to be positively kept in place, this being illustrated more in detail in FIG. 6 and 7. Thus FIG. 6 shows roof element 48 in elevation, with a rotatable locking pin 63, mounted in a bushing 65 (see FIG. 7) and provided with locking projections 66 adapted to co-operate with mating seats or the like in holes 61 or 62 in the top interface frame in connection with component 43C. Rotation of the pin 63 can be effected by means of a suitable tool engaging the top 67 of the pin. A locking means 60 shown as a whole in detail in FIG. 6, is also indicated at 60 on the roof element 48 in FIG. 4.

The small roof elements, such as elements 48 and 49, can be designed so as to be unlocked and removed either by an ROT or an ROV. In the case of ROT operation, arrangements as described in simultaneous patent application U.S. Ser. No. 07/684,944 (ROT Interface) may be of interest.

Turning again to FIG. 6, one side of the removable roof element shown therein is provided with a flexible lip 69 adapted to overlie adjacent roof elements such as the fixed element 46 in FIG. 4 in order to bridge the possible gap between these elements. The flexible lip 69 can, for example, be made of neoprene. Such flexible lips may be provided for the junctions between the various elements as necessary.

In the case of removable roof elements being at least partly supported by adjacent fixed roof elements, there may be obtained a kind of two-step action when an object falling from above hits a removable roof element. This action is possible if the deformability of the removable roof elements is higher than that of the supporting fixed roof elements. Under the force exerted by the falling object, the removable roof element will first be crushed or deformed to some extent, and then the forces to an increased extent will be transferred to the fixed roof element or elements, subsequently causing deformation also thereof. This accummulated or two-step deformation process will make it possible to absorb more energy from falling objects, than each individual element can absorb, given the same or similar element structures.

The roof elements for a particular subsea structure can, for example, be designed to resist a dropped object energy of 100 kJ applied by a object with a right angled corner impact, but with a punching perimeter dimension not less than a 500 mm diameter circle. Retardation is typically by plastic deformation of crushable tubulars over a distance of 250–500 mm. After these tubulars are crushed, the remaining loads are transferred to the template via the module structure and the central module connector. Smaller hatch covers for access to chokes, control pods, valves or the like are designed for a dropped object energy of 10 kJ with a punching perimeter dimension not less than 150 mm diameter circle.

As just explained, retardation of dropped object energy generally implies some degree of structural damage. The acceptable extent of this damage on the serviceability of the subsea structure may be defined as follows, still considering the above example.

A 100 kJ dropped object must not:

Damage the integrity of a primary hydrocarbon pressure barrier

Remove the ability to kill a well

Remove the ability to retrieve a module

Remove the ability to restore the subsea structure to its original operational condition.

A 100 kJ dropped object may:

Compromise the ability to utilise the ROT on a removable module

Damage non-essential module equipment, for example a tree cap connector.

Referring now finally to the complete subsea structure shown in FIG. 1, it will be seen that essentially the entire top area of the subsea structure is covered by roof elements, giving complete protection to the equipment and components mounted within the template. With the modules properly installed onto the template, the module roof elements are lying exactly at the same level, providing for a completely snag-free surface at the top of the subsea structure without any significant part thereof protruding above the flush roof elements. This, among other things, will allow any trawl to glide over the subsea structure without causing damage. In this connection it should be noted that in addition to the fixed and removable roof elements supported by the modules, there may be provided one or more roof elements supported directly by the template structure. Examples of such directly supported roof elements are shown at 29A and 29B in FIG. 1. Such roof elements may be fixed elements and would normally be used above such parts of the template or equipment where no access is required during underwater operation. They can, however, also be removable, of a type similar to roof elements 48 and 49, where access is required, for example, above insert valves retrievable by an ROT.

We claim:

1. Arrangement for protecting components incorporated in subsea systems below a surface of a sea, particularly for hydrocarbon production, comprising:

a plurality of functional modules for containing at least one of the components, having a top area, adapted to be retrieved to the surface;

a subsea template structure adapted to rest on a sea bed, having a top area, provided with supporting members supporting the plurality of functional modules;

each of the functional modules being provided with roof elements including at least one fixed roof element and at least one removable roof element, the fixed and removable roof elements together covering substantially the entire top area of the module, and the roof elements of all modules in the subsea structure together covering substantially the entire top area of the module, and the roof elements of all modules in the subsea structure together covering a major portion of the top area of the subsea structure, to protect against objects falling from above or moving along the sea bed;

the roof elements having a deformability adapted to be permanently deformed or crushed when a falling object results in an impact force thereon exceeding a predetermined threshold value;

the fixed roof element of each module being adapted along an edge portion thereof to form a support for the removable roof element of each module;

the deformability of the removable roof element being higher than the deformability of the fixed roof element, whereby a sufficiently large impact force from a falling object on the removable roof element will lead to a stepwise deformation first of the removable roof element and then of the fixed roof element;

a load from the roof elements of the modules being transferred to the supporting members of the template structure through the modules; and the roof elements of all modules lying substantially in a common plane without any significant part of the subsea structure protruding above the roof elements.

2. Arrangement according to claim 1, wherein at least one roof element is supported directly by the template structure.

3. Arrangement according to claim 2, wherein the at least one roof element supported directly by the template structure is one of the removable roof elements.

4. Arrangement according to claim 1, wherein at least one module has at least one fixed roof element along at least one side of the module, and at least one removable central roof element covers a central portion of the top area of the module, the central portion being adapted to be recovered by a module running tool during installation and retrieval operations.

5. Arrangement according to claim 4, wherein the central removable roof element is adapted to be installed by a guideline establishment tool and held in position by gravity.

6. Arrangement according to claim 1, further comprising a flexible, flat element provided along at least one side edge of at least one removable roof element, for overlapping with edge portions of an adjacent roof element, to avoid a gap between the roof elements.

7. Arrangement for protecting components incorporated in subsea systems particularly for hydrocarbon production, comprising:

A plurality of functional modules for containing at least one of the components, adapted to be retrieved to the surface;

a subsea template structure adapted to rest on the sea bed, provided with supporting members supporting the plurality of functional modules;

each of the functional modules being provided with roof elements, including at least one fixed roof element along at least one side of the module, and a removable roof element covering a central portion of the top area of the module, the central portion being adapted to be recovered by a module running tool during installation and retrieval operations;

The roof elements of at least one module further including at least one smaller roof element for covering components arranged for cooperation with a module running tool, provided with locking means to be operated by the module running tool, for securing the smaller roof element in position on the module;

the fixed and removable roof elements together covering substantially the entire top area of the module, and the roof elements of all modules in the subsea structure together covering a major portion of the top area of the subsea structure, to protect against objects falling from above or moving along the sea bed;

the roof elements having a deformability adapted to be permanently deformed or crushed when a falling object results in an impact force thereon exceeding a predetermined threshold value;

the fixed roof element of each module being adapted along an edge portion to form a support for the removable roof element of each module;

the deformability of the removable roof elements being higher than the deformability of the fixed roof elements, whereby a sufficiently large impact force from a falling object on the removable roof element will lead to a stepwise deformation first of the removable roof element and then of the fixed roof element;

a load from the roof elements of the modules being transferred to the supporting members of the template structure through the modules; and the roof elements of all modules lying substantially in a common plane without any significant part of the subsea structure protruding above the roof elements.

8. Arrangement according to claim 7, wherein the removable central and smaller roof elements are adapted to be at least partially supported by support means integrated into edge portions of at least one fixed roof element.

9. A method of protecting components in subsea systems, comprising:

levelling and securing a template to a seabed;

installing a module into the template;

unlocking and retrieving a removable roof element from the module;

unlocking and retrieving a component from the module; and protecting the module with a fixed roof element during the unlocking and retrieving steps.

10. The method of claim 9, further comprising the step of retrieving the module.

* * * * *